US005127633A

United States Patent [19]

Mailliet

[11] Patent Number: 5,127,633

[45] Date of Patent: Jul. 7, 1992

[54] APPARATUS FOR INSTALLING OR REMOVING SHAFT FURNACE TUYERES OR TYMPS

[75] Inventor: Pierre Mailliet, Howald, Luxembourg

[73] Assignee: Paul Wirth S.A., Luxembourg, Luxembourg

[21] Appl. No.: 647,826

[22] Filed: Jan. 31, 1991

[30] Foreign Application Priority Data

Feb. 14, 1990 [LU] Luxembourg ..... 87676

[51] Int. Cl.[5] ..... C21B 7/16

[52] U.S. Cl. ..... 266/271; 266/287

[58] Field of Search ..... 266/265, 269, 271, 287, 266/197

[56] References Cited

U.S. PATENT DOCUMENTS 4,087,084 5/1978 Meyers ..... 266/287

FOREIGN PATENT DOCUMENTS 2530180 of 1975 Fed. Rep. of Germany .

2321543 3/1977 France .

0110632 7/1982 Japan ..... 266/271

0121210 6/1985 Japan ..... 266/269

0678067 8/1979 U.S.S.R. ..... 266/271

0438646 8/1980 U.S.S.R. .

0818487 6/1981 U.S.S.R. .

0847436 9/1982 U.S.S.R. .

*Primary Examiner*—S. Kastler

*Attorney, Agent, or Firm*—Fishman, Dionne & Cantor

[57] ABSTRACT

The apparatus comprises a hydraulic ram mounted on a movable support designed to be placed in line with the axis of the tuyere or tymp so as to bear on the furnace wall and to act on a gripper composed of two telescopic members respectively displaceable relative to one another in the axial direction of the tuyere or of the tymp in order to ensure the support of the latter, said gripper being axially displaceable through the action of said ram. The hydraulic ram is a double piston ram comprising a traction piston acting on a pulled member of the gripper and a thrust piston acting on a propelled member of the gripper, and is consequently suitable for all forms of tuyeres and tymps.

16 Claims, 14 Drawing Sheets 20
22
24
26
28
30
32
34
36
38
40
42
44
46

20
22
24
26
28
30
32
34
36
38
40
42
44
46

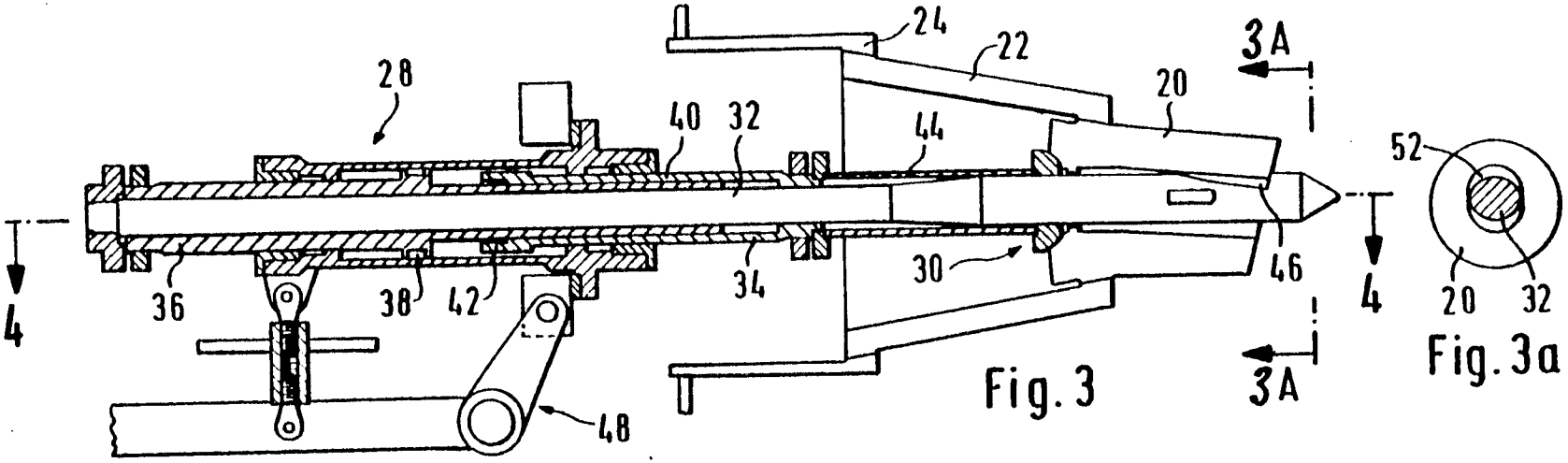
Fig. 3a
Fig. 3
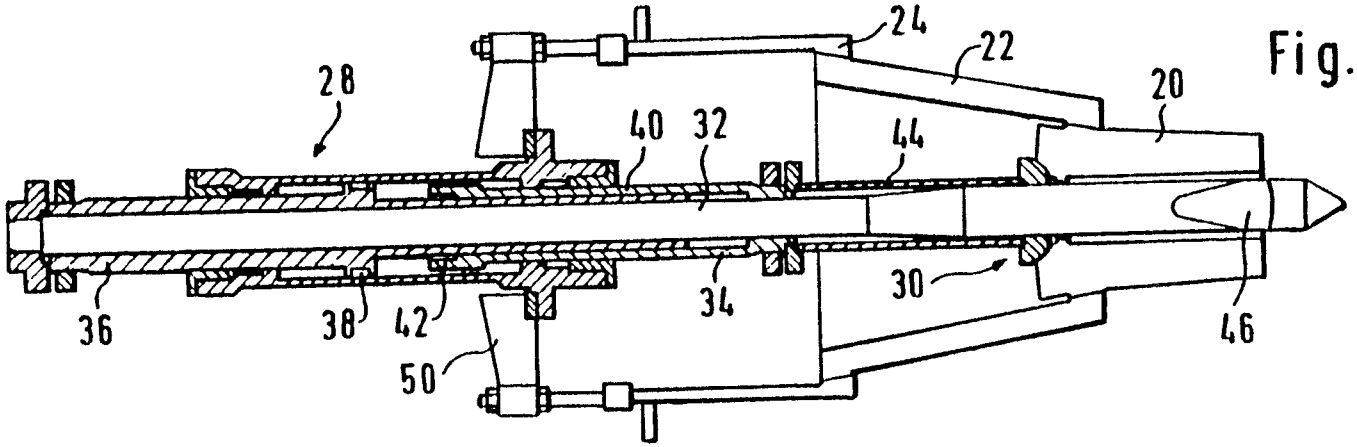
Fig. 4

APPARATUS FOR INSTALLING OR REMOVING SHAFT FURNACE TUYERES OR TYMPS

TECHNICAL FIELD

The present invention relates to an apparatus for installing or removing shaft furnace tuyeres or tymps.

BACKGROUND OF THE INVENTION

An apparatus for installing or removing a tuyere or a tymp from a shaft furnace is described in Luxembourg Patent No 65 246. Although this apparatus operates to the satisfaction of its users, the aim of the present invention is to provide a novel, improved apparatus of this kind which gives better performance and is suitable for all forms of tuyeres and tymps.

SUMMARY OF THE INVENTION

In order to achieve this aim, the apparatus proposed by the present invention is essentially characterized in that the hydraulic ram is a double piston ram comprising a traction piston acting on a pulled member of the gripper and a thrust piston acting on a propelled member of the gripper.

The pulled member is preferably a cylindrical rod which has a cross section smaller than the smallest passage cross section of the tuyere and which passes axially through the ram from one end to the other. This rod is fixed on a first coaxial sheath passing leak-tightly through the rear face of the ram and, inside the ram, comprises said traction piston.

At its end near the furnace, this rod may be provided with a notch forming a hook intended to grip the inside edge of the tuyere.

The propelled member of the gripper preferably consists of a second coaxial sheath extending around said rod and partly around the first sheath and leak-tightly passing though the front face of the ram, this sheath comprising, inside the ram, the aforesaid thrust piston.

A cylindrical extension may be provided for fastening on the free end of said second sheath, so as to bear against the outside edge of the tuyere.

The hydraulic ram support is preferably provided with means for modifying the inclination of the ram relative to the horizontal.

For the purpose of manipulating the tymp, a grab is provided for hooking the tymp to the gripper, said grab being designed to be fixed on the propelled member of the gripper and to be actuated by the pulled member.

This grab preferably comprises three pairs of convergent legs adapted to be engaged in the tymp, three claws housed respectively between each of the three pairs of legs and distributed regularly at intervals of 120° around the pulled member. By their ends near the ram, these claws bear on an end plate fixed on the propelled member and at the opposite end are adapted to open out and retract radially towards respective closed and open positions through the action of an axial displacement of the pulled member.

The three claws can be opened out by means of three curved spring blades provided on a sleeve fixed on the pulled member, while the retraction of the claws against the action of the spring blades can be effected by means of cams provided on said sleeve and associated with inclined ramps on the claws, through the action of an axial displacement of the pulled member.

In addition, each claw is preferably axially displaceable between stops provided on the corresponding legs.

In order to facilitate the unlocking both of the tuyere and the tymp, it is preferable to provide a compressed air percussion hammer fixed on said first sheath and acting directly on the rod of the pulled member.

BRIEF DESCRIPTION OF THE DRAWINGS

Further features and characteristics will emerge from the description of several preferred embodiments, which are described below by way of illustration and with reference to the accompanying drawings, in which:

FIG. 3 is a similar view of the apparatus when the ram is operated to hook the tuyere;

FIG. 3*a* is a vertical section in the sectional place A—A in FIG. 3;

FIG. 4 is a horizontal section in the plane B—B in FIG. 3;

DETAILED DESCRIPTION OF THE INVENTION

Figure 1:
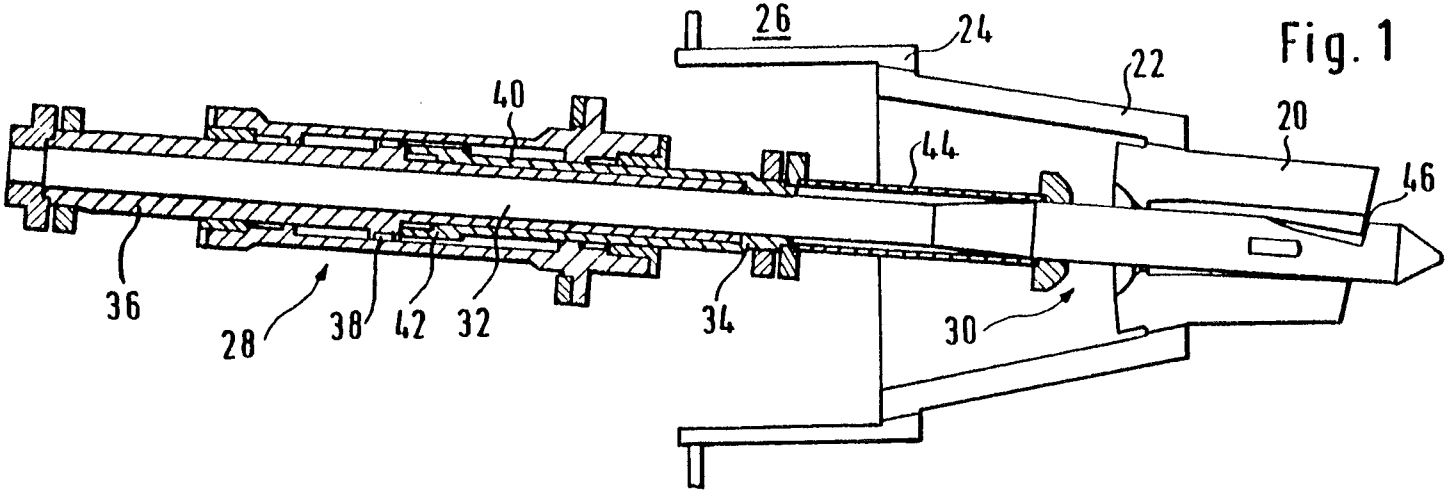
FIG. 1 shows schematically a longitudinal section of a simplified version of the apparatus according to the present invention, in the introduced position for the extraction of the tuyere.

The first embodiment of the apparatus according to the present invention is illustrated in FIGS. 1 to 6 and is shown in connection with its implementation for the extraction of a tuyere 20 wedged in a tymp 22, which in turn is held in the main arch 24 of the shaft furnace wall 26.

The apparatus includes a double piston hydraulic ram 28 for actuating a gripper 30 composed of telescopic members. This gripper 30 comprises a pulled member 32 consisting of a long cylindrical rod 32 and a pushed or propelled member 34. The rod 32 passes axially through the hydraulic ram 28 and its rear end is fixed to a first sheath 36 lying coaxially around the rear portion of the rod 32 and housed leak-tightly in the rear face of the ram 28, in the form of a hydraulic piston 38 acting on the rod 32. The propelled member 34 is designed in the form of a second cylindrical sheath 40 disposed coaxially around the rod 32 and around the front portion of the first sheath 36. This second sheath 40 is housed leak-tightly in the front face of the ram 28 and forms, inside the latter, a propelled hydraulic piston 42. By virtue of this design of the hydraulic ram, of which several embodiments will be described below, it is possible to actuate the two members 32 and 34 of the gripper 30 either separately from one another or together.

The propelled member 34 of the gripper 30 may be extended by a cylindrical extensin 44 lying around the rod 32 and intended to bear against the outer face of the tuyere 20. The rod 32 is in turn provided at its free end with an oblique notch 46 forming a hook adapted to be engaged around the inside edge of the tuyere 20.

A description will now be given, with reference to FIGS. 1 to 6, of the different phases of the extraction and removal of the tuyere. In this context, it should be be recalled that tuyeres are generally disposed in such a manner as to inject hot air downwards into the furnace, so that, as illustrated in the figures, the tuyeres are so disposed that their longitudinal axis forms an angle of the order of 5° to the horizontal.

For the purpose of removing a tuyere 20, the apparatus, which is mounted on a movable carriage (not shown), is brought to the tuyere in question and is inclined in such a manner that the axis of the rod 32 is situated in line with the axis of the tuyere 20, this being achieved with the aid of a support 48 shown schematically, without details, in FIG. 3 and making it possible in a manner known per se to vary the inclination of the ram 28 and gripper 30. The apparatus is then moved in the direction of the axis of the tuyere 20 in order to cause the rod 32 to penetrate through the latter, as illustrated in FIG. 1, the end of the rod 32 preferably being pointed to assist its penetration into the tuyere 20. From the position shown in FIG. 1, the ram 28 can be straightened to occupy a horizontal position axially in alignment with the tymp 22 and the main arch 24.

Figure 2:
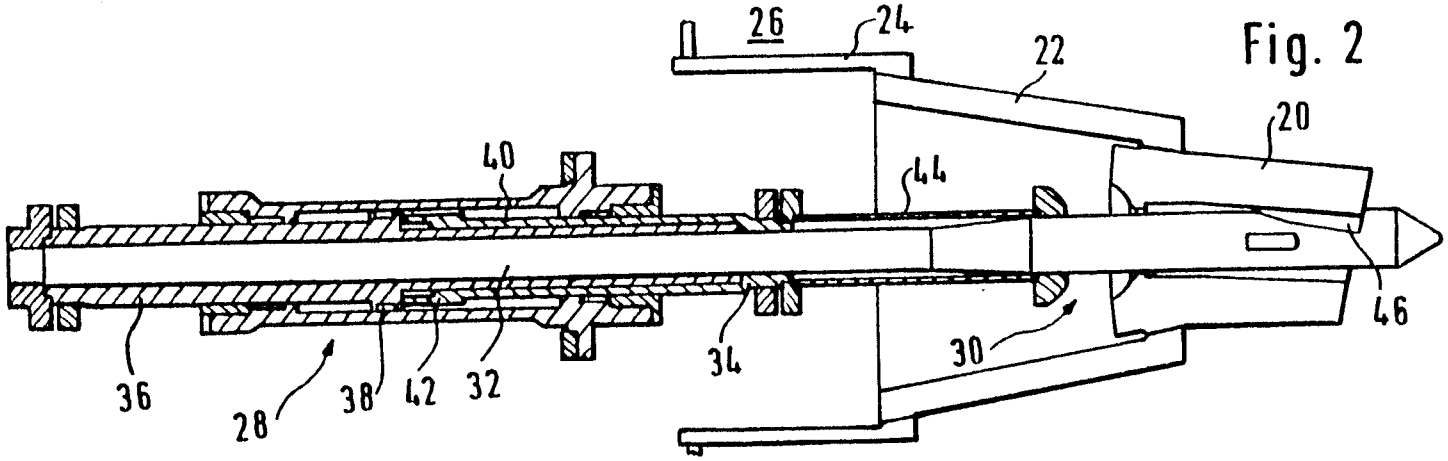
FIG. 2 is a similar view showing the apparatus in the horizontal position.

In the position shown in FIG. 2, the ram 28 is put into action, thereby, having regard to the particular arrangement of the pistons 38 and 42, giving rise to a movement of the latter in the opposite direction, as illustrated by comparison of FIGS. 2 and 3. This operation of the ram 38 consequently brings about the forward movement of the propelled member 38 until the extension 44 comes into contact with the outer surface of the tuyere 20, and the backward movement of the pulled member 32 of the gripper 34 until the notch 26 comes into contact with the inside edge of the tuyere 20, so that the latter is hooked by a crescent-shaped surface 52 of the notch 46, as shown in FIG. 3*a*. The tuyere 20 is from then on held between the movable members of the gripper 30. At that moment the phase of extraction of the tuyere 20 starts. For this purpose, the hydraulic pressure between the two pistons 38 and 42 is maintained, while the chamber at the rear of the piston 38, around the sheath 36, is decompressed, so that the hydraulic pressure of the ram 42 is converted into traction on the rod 32. In order to restrain the counter reaction of this traction force, it is preferable to provide the ram 28 with a bracket 50 bearing against the main arch 24. On the other hand, in view of the fact that when the tuyere (or the tymp) is forced into place the counter reactions take place in the opposite direction, it is preferable that the bracket 50 should be so designed that it can also be hooked onto the main arch.

Figure 5:
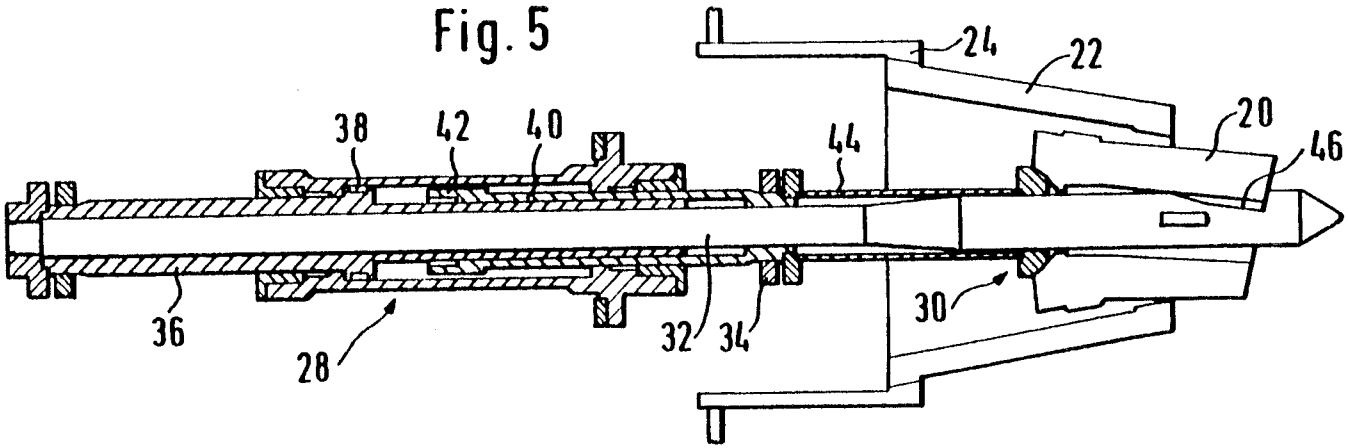
FIGS. 5 and 6 illustrate two successive phases of the extraction of the tuyere.
Figure 6:
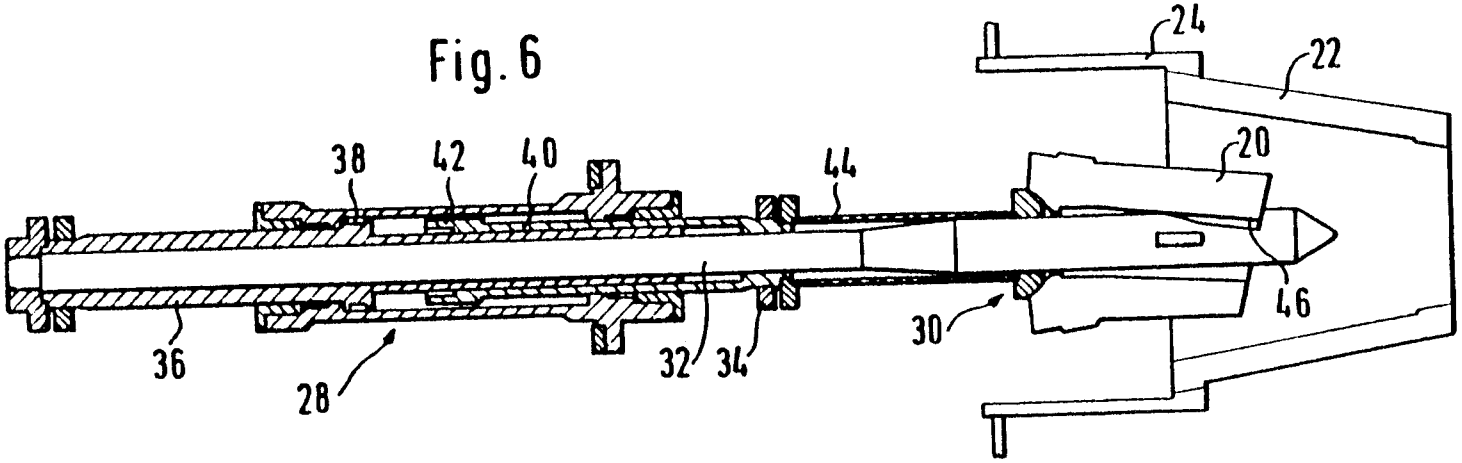

The traction on the rod 32 first frees the tuyere 20 from its seat inside the tymp 22, as shown in FIG. 5, and extracts it through said tymp until the traction piston 38 has completed its stroke. From this position, which is illustrated in FIG. 5, the tuyere 20 can be completely disengaged by the recoil of the carriage (not shown) on which the apparatus is mounted. The installation of a new tuyere 20 comprises the same phases of operation as are described above, but of course in reverse order.

Before the new tuyere 20 is installed, it is also possible to remove the tymp 22. For this purpose, the extension 44 used for removing the tuyere 20 is replaced by a grab 60, which is shown in FIGS. 7 and 8 and which is fixed on the free end of the propelled member 34 and makes it possible to grip and support the tymp 22.

Figures 7, 7A, 7B, 7C, 7D:
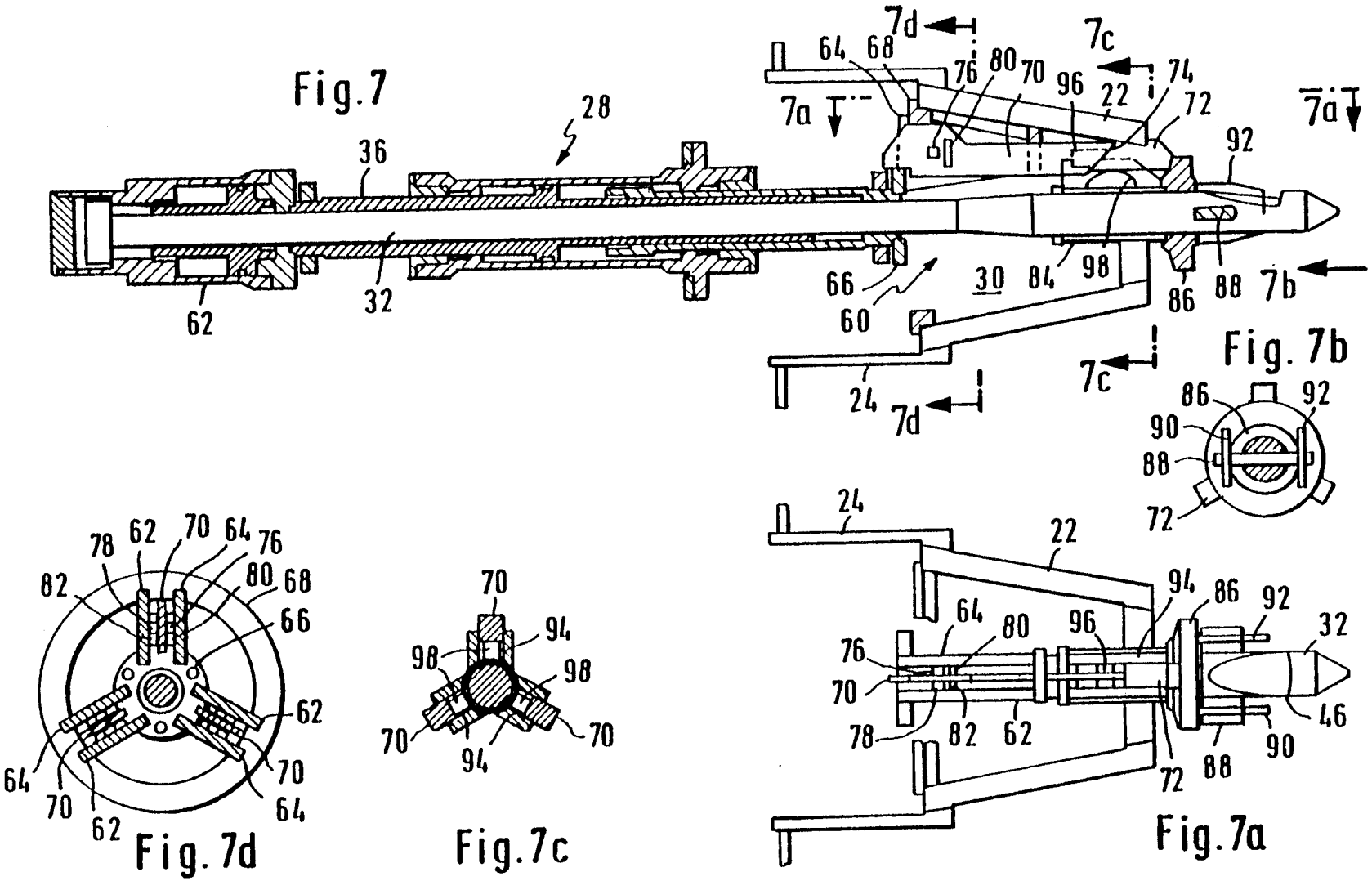
FIG. 7 is a vertical section of a preferred embodiment provided with a device for hooking the tymp.
FIGS. 7*a*, 7*b*, 7*c* and 7*d* are respectively sections in the sectional planes A—A, B—B, C—C, D—D in FIG. 7.
Figure 8:
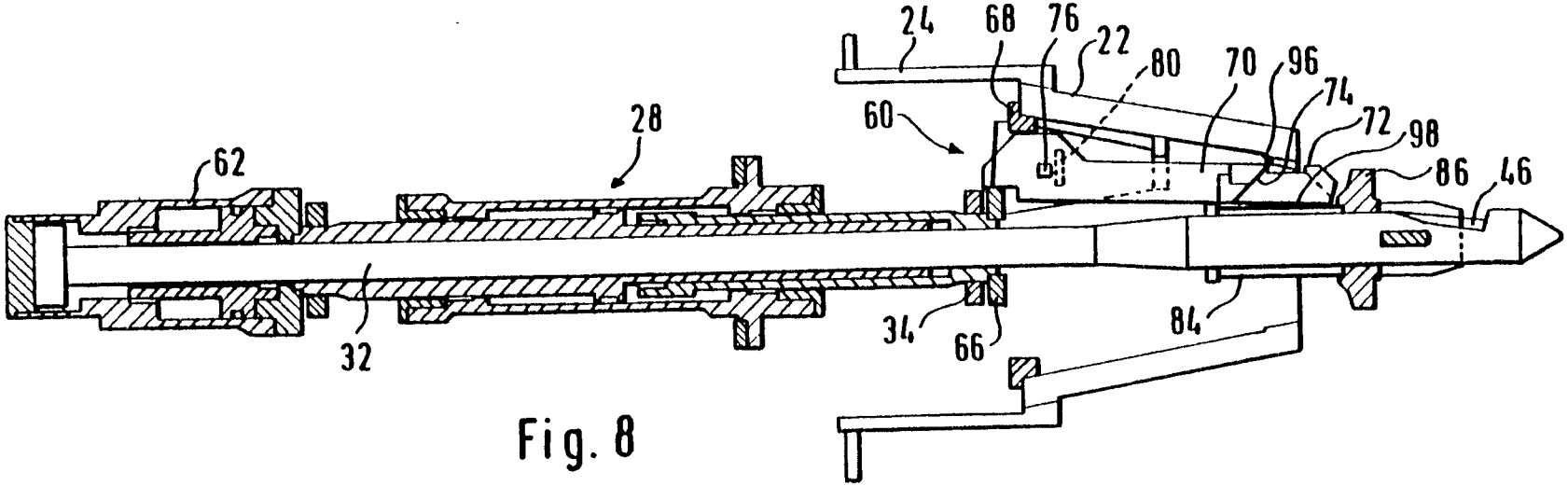
FIG. 8 is a similar view to that shown in FIG. 7, in the tymp-release phase.

Apart from the presence of the grab 60, the embodiment illustrated in FIGS. 7 and 8 differs from the embodiment shown in the preceding figures through the presence of a compressed air percussion hammer 62. A percussion hammer of this type, which is known Per se can be fixed outside the ram 28 on the first sheath 36, while the rod 32 is extended into the interior of the hammer 62, where it is actuated directly by the latter. The aim of this percussion hammer 62 is to assist the ram 28 in the initial phase of the disengagement of the tymp 22 for the purpose of freeing it from its seat. It is, of course, possible to use the apparatus shown in FIG. 7 with a percussion hammer 62 for the disengagement of the tuyere 20 after replacing the grab 60 by the extension 44.

The grab 60 is composed of a support consisting of three pairs of legs 62, 64 fixed in a star pattern on a plate 66 attached to the end of the propelled member 34 of the gripper 30. These three pairs of legs extend axially around the rod 32 and converge slightly toward the end of the latter to match the frustroconical shape of the tymp 22. These legs 62, 64 are in addition encircled by a collar 68 in order to give them rigidity and to bear against the outer edge of the tymp 22 (see also FIG. 7 D).

The grab 60 also comprises three claws 70 provided respectively between each of the three pairs of legs, 62, 64 and designed in the form of elongate flat levers, one end of which bears against the end plate 66, while the opposite end is designed in the form of a hook 72 which, in the closed position of the grab 60 as shown in FIG. 7, is hooked behind the inside edge of the tymp 22. In this position the tymp is consequently held between the collar 68 and the three hooks 72 of the three gripper 70.

Comparison of FIGS. 7C and 7D shows that the outside part of the claws, at the end near the end plate 66, is relatively narrow, while the inside part at the opposite end is thicker. The transition between the narrow part and the wider part of each of the claws 70 is formed by at least one inclined ramp 74, preferably two such ramps, one on each side of each of the claws 70 (see FIG. 7). Each of the three claws 70 is in addition provided with two lateral snugs 76, 78 intended respectively to cooperate with stops 80, 82 provided on the corresponding opposite inside faces of the legs 62, 64.

The operation of the claws 70 of the grab 60 is effected with the aid of a hollow member engaged on the end of the rod 32 and consisting of a cylindrical sleeve 84 fastened to a plate 86. This member is held in place with the aid of a key 88 engaged through a diametrical opening in the rod 32 and corresponding openings in two lugs 90, 92 extending to the rod 32 towards the end of the latter (see FIGS. 7A and 7B).

Three longitudinal grooves 94 on the cylindrical sleeve 84 extend radially toward the outside and are regularly distributed at intervals of 120° around the sleeve 84 to correspond respectively to each of the paris of legs 62, 64 and to contain respectively each of the three claws 70. Cams 96 are disposed on the inside flanks of the three grooves 94 (see FIG. 7) and are intended to cooperated with the inclined ramps 74 of each of the claws 70. Each of the three grooves 94 also contains spring blades 98 (see FIGS. 7 and 7C) provide on the sleeve 84, the elasticity of said springs tending to curve them as shown in FIG. 7.

Comparison with FIGS. 7 and 8 will show that the grab 60 is operated by radial opening out or retraction of the inside ends of each of the claws 70, this operating being brought about by the axial displacement of the rod 32 through the action of the ram 28, the operation of said rod being as follows: for the purpose of freeing the tymp 22 from the closed position of the gripper 30 and of the grab 60, the rod 32 is displaced to the right in FIG. 7, the member 34 remaining in place. When the rod 32 is displaced in this manner, the end plate 86 first frees the inside end of each of the three claws 70, while the cams 96 move nearer to the ramps 74 of the claws. From the moment when the cams 96 come into contact with the ramps 74, the claws 70, which are not fixed to the grab support either in the longitudinal direction or in the radial direction, are also driven to the right until the snugs 76, 78 on the claws 70 are halted by the stops 80, 82 on the legs 62, 64. This axial translation of the claws 72 is sufficient to disengage them axially from the inside face of the tymp 22. Continuation of the movement of the rod 32 to the right in FIG. 7 causes the cams 96 to act on the inclined ramp 74 in view of the fact that the claws 70 are not halted by the stops 80 82. As shown in FIG. 8, this brings about the radial retraction of each of the claws 70 against the action of the spring blades 98, on the incline ramps 74. When the claws 70 are completely retraced and occupy the position shown in FIG. 8, the gripper 30 and the grab 60 can be extracted axially through the tymp 22, displacing first the member 34 under the action of the ram 28 to the left and then the ram 28 with the gripper 30.

Figure 9:
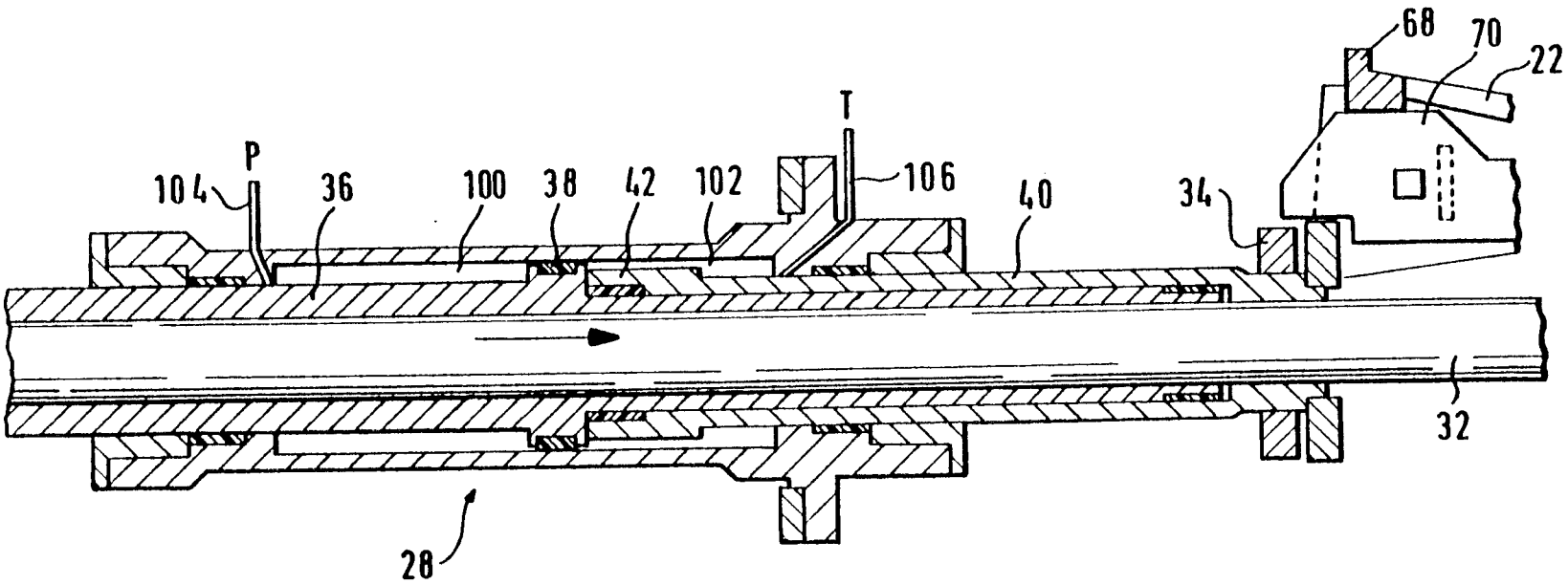
FIGS. 9–13 illustrate the operation of a first embodiment of a hydraulic ram with the aid of partial axial sections showing different phases of the operation.

The removal of a tymp comprises the same sequences as the installation of a tymp, but in the reverse order. However, this removal will be described below in greater detail with reference to FIGS. 7 and 8 and with the assistance of FIGS. 9 to 13, which show schematically partial views of the ram, for the purpose of explaining the operation of the embodiment of the ram which is illustrated in the preceding figures. As shown in FIG. 9, the piston 38 defined for the needs of the description as a traction piston slides leak-tightly inside the ram 28, where it forms two annular chambers 100 and 102. Each of these chambers 100 and 102 is connected to a hydraulic liquid pipe, 104 and 106 respectively, these pipes being designated P when the pipe is connected to the hydraulic pump and T when it is connected to the reservoir, that is to say when it is not under pressure. The piston 42, referred to hereinafter as the thrust piston, moves in the chamber 102. Unlike the traction piston 38, the thrust piston 42 has a cross section smaller than the cross section of the chamber 102 and does not move leak-tightly in the latter. On the other hand, the thrust piston 42 can slide leak-tightly on the sheath 36 to which the traction position 38 is fastened.

For the purpose of removing the tymp 22, the apparatus is brought into the position shown in FIG. 8, the gripper 30 being in the open position, that is to say the claws 70 are retracted. The penetration of the gripper 30 through the tymp 22 is achieved through the action of the hydraulic ram 28. For this purpose, the first chamber 100 is pressurized through the pipe P, while the second chamber 102 is depressurized through T. Consequently, the piston 38 is propelled to the right in FIG. 9, driving the piston 42 with it, which means that the two members 32 and 34 move forward together to the right in FIG. 8, but that their mutual positions do not change. This movement is continued as far as the position shown in FIG. 8, which corresponds for example to the positions of the pistons 38 and 42 shown in FIG. 9.

Figure 10:
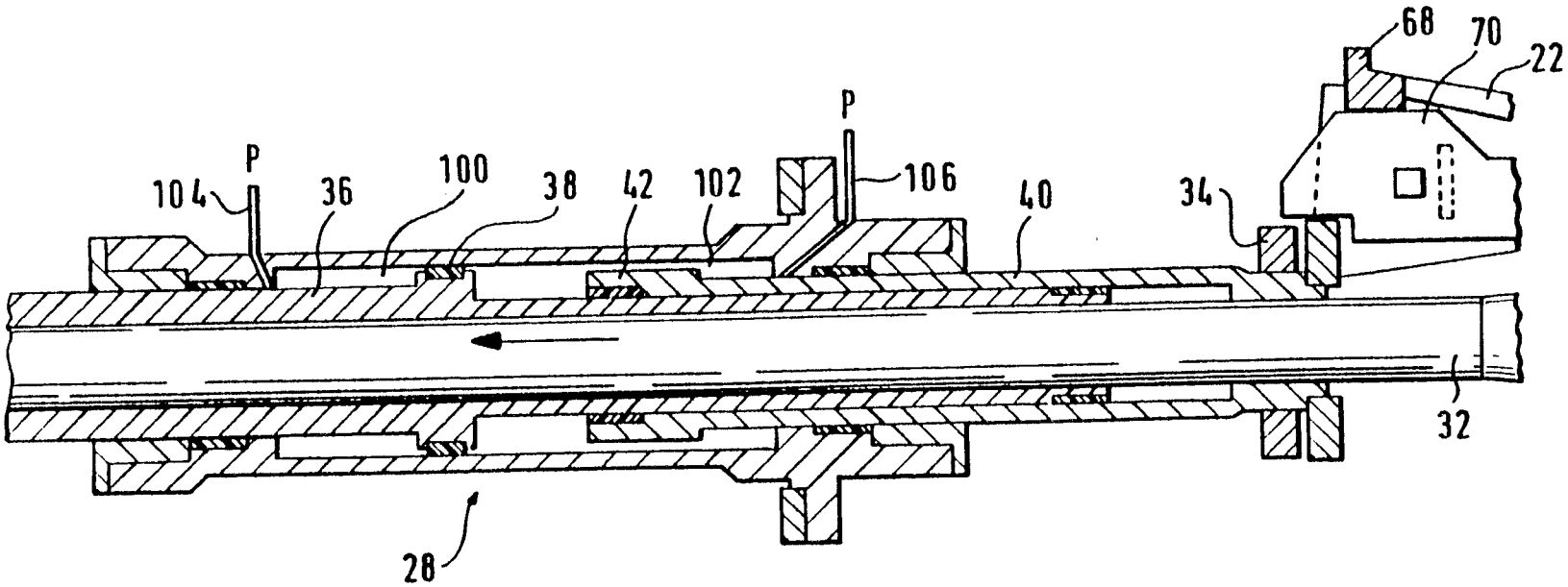
Figure 11:
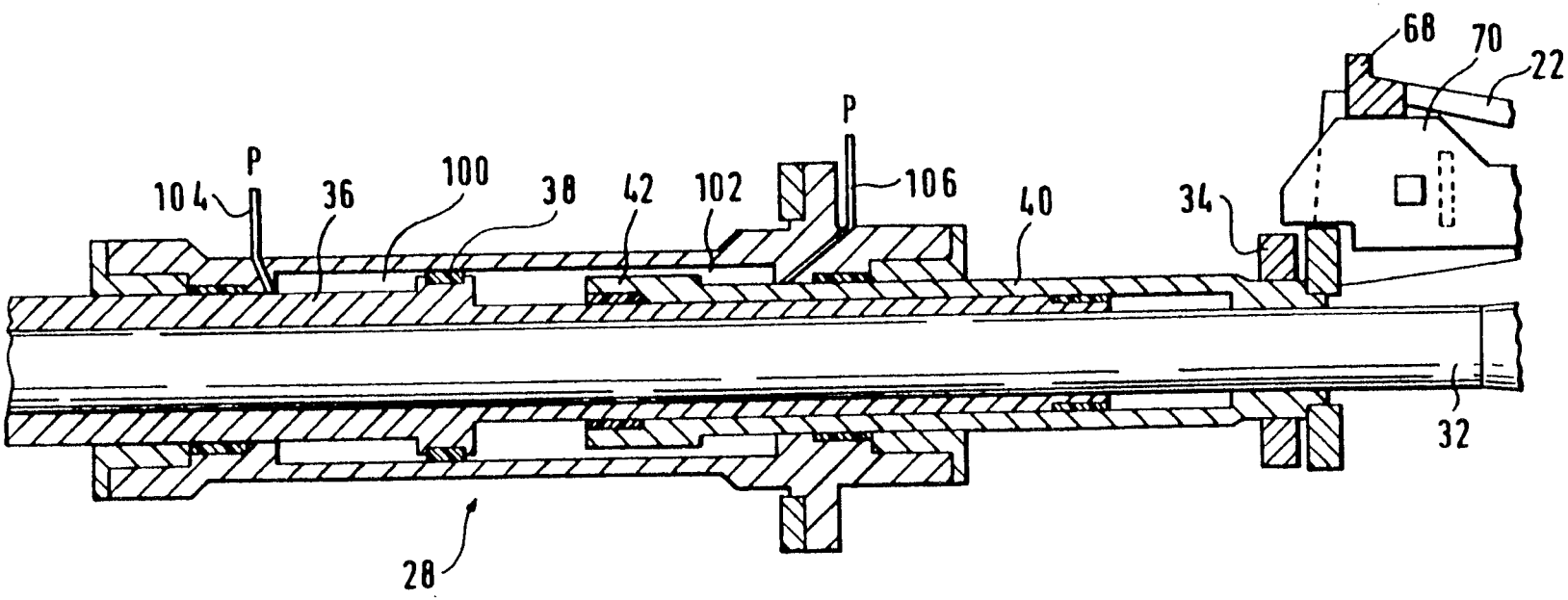

In this position, the hydraulic connection 106 of the second chamber 102 is changed over to the pressure P (see FIG. 10). The pressure of the hydraulic liquid is consequently the same in the two chambers 100 and 102, which means that the piston 38 is subjected to the same pressure on both sides. However, since its exposed surface in the chamber 102 is greater that that exposed to the pressure of the chamber 100, this piston 38 is subjected to a differential force which moves it to the left in FIG. 9. As regards the piston 42, for the same reasons, that is to say because its exposed surface on the left is greater than that exposed on the right, this piston is subjected to a differential force towards the right, but since the grab 60 is wedged on the tymp 22 by the collar 68 and since the member 34 of the gripper 30 cannot move in that direction, the thrust piston 42 remains in place despite the differential force to which it is subjected.

The displacement of the piston 38 gives rise to traction on the rod 32, which consequently is displaced to the left from the position shown in FIG. 8. This movement effects the disengagement of the cams 96 from the inclined ramps 74 of the claws 70, in order to free the latter from the action of the spring blades 98. The elastic deformation of these blades 98 to the position shown in FIG. 7 and the continuation of the movement of the rod 32 bring about the sliding of the claws 70 through the action of the end plate 86, to the left to the position shown in FIG. 7, in which the tymp 22 is hooked between the claws 70, on the one hand, and the collar 68 on the other hand.

From that moment it is possible to actuate the percussion hammer 62 in order to free the tymp 22 from its seat on the main arch 24. At the same time, the chamber 100 is depressurized by connecting the pipe 104 to T (see FIG. 11).

Figure 12:
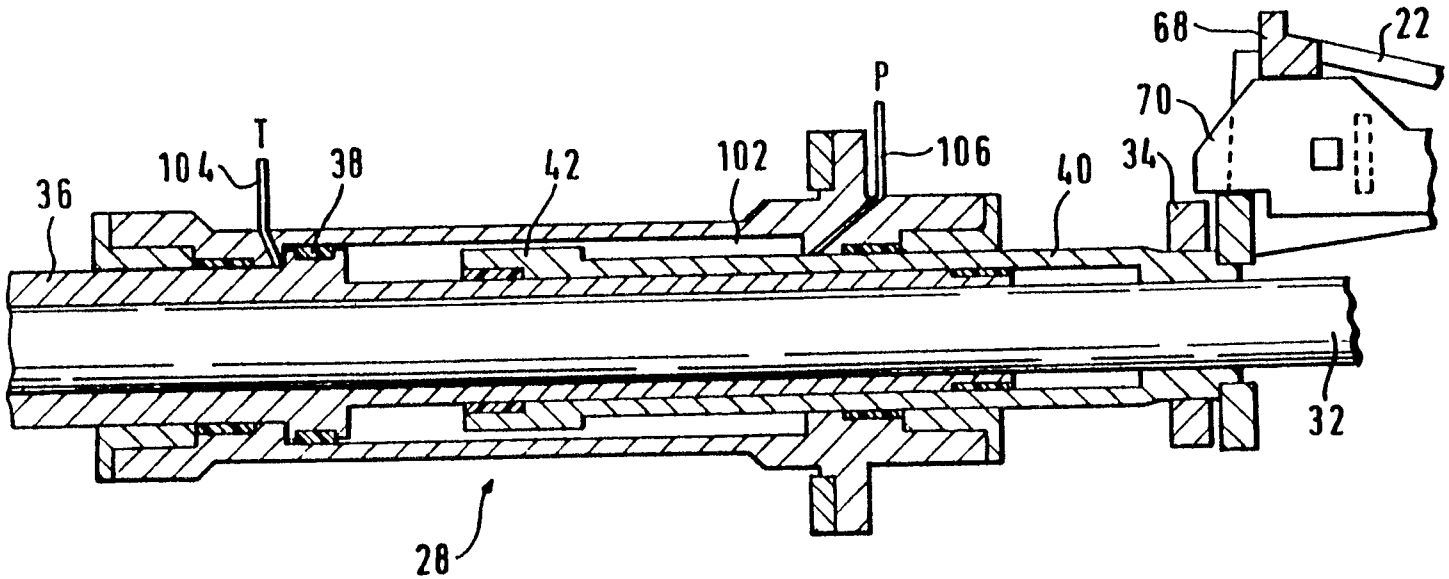

The piston 38 is consequently subjected to the full pressure of the chamber 102, so that it is pushed back to the left up to the position shown in FIG. 12. This means that the tymp 22 is extracted from the main arch 24 through the action of the traction of the rod 32 and of the plate 86. The piston 42 must obviously follow the movement of the piston 38 through the action of the traction applied to the gripper 30 by the rod 32, despite the fact that it is exposed to a differential force towards the right, which force in addition holds the gripper closed. During this extraction phase, the ram is held bearing against the main arch by means of the bracket 50 shown in FIG. 4 and not shown in FIGS. 7 and 8. FIG. 12 illustrates the end of the operation of the ram 28 during the phase of removal of the tymp 22. The operation of the ram 28 during the removal of a tuyere 20 is comparable to that described above (FIGS. 1 to 5).

Figure 13:
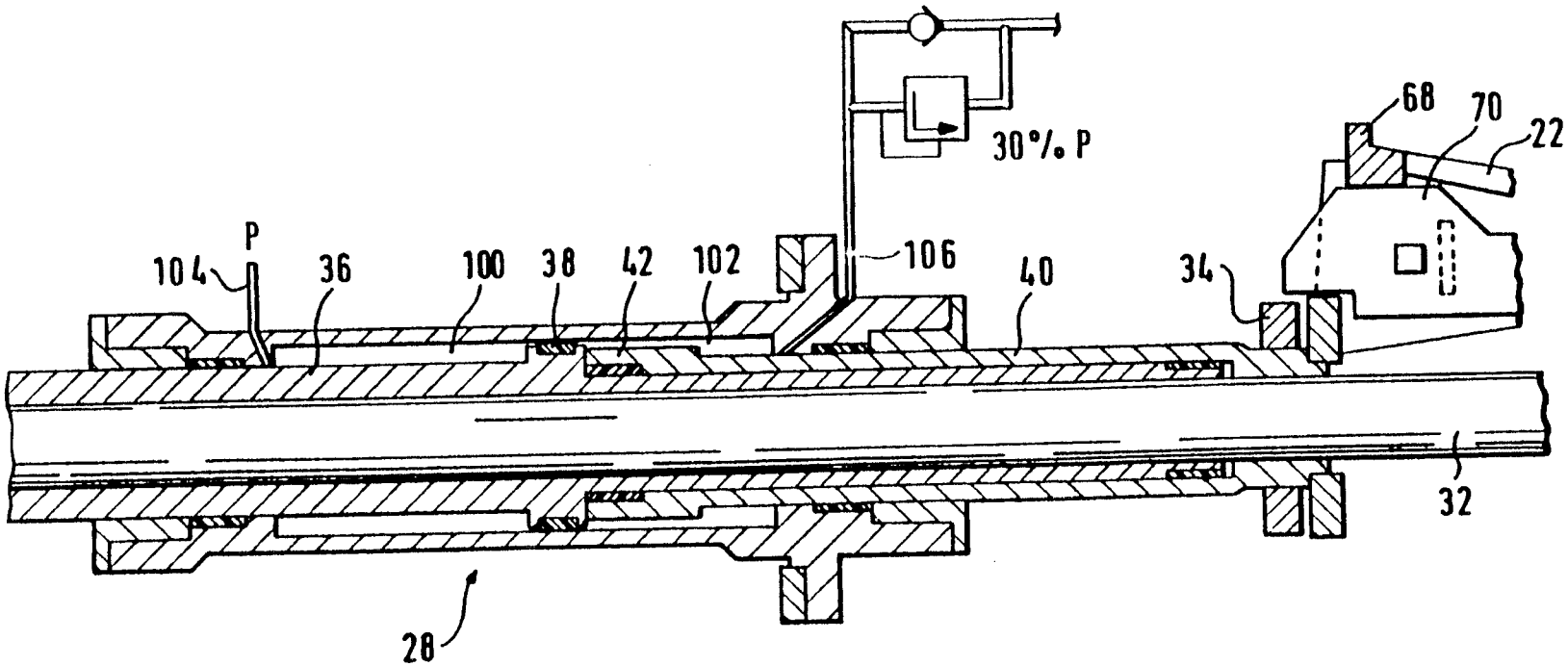

FIG. 13 illustrates the operation of the ram 28 during the installation of a tuyere or a tymp wedged in the closed gripper 30. For this purpose, the chamber 100 is placed under hydraulic pressure by connecting the pipe 104 to P in order to push back the piston 38 and also the rod 32 to the right in FIG. 13. However during this movement phase it is not possible to connect the chamber 102 to T, because it is necessary for the piston 42 to be subjected to a certain pressure towards the right so that the gripper remains closed. It is likewise not possible to connect the chamber 102 to P, because it is necessary that the piston 38 should be able to be pushed back toward the right. The compromise consists in maintaining in the chamber 102 an intermediate pressure by connecting the pipe 106 to a pressure equivalent to a traction of the pressure P, for example one third of P.

Figure 14:
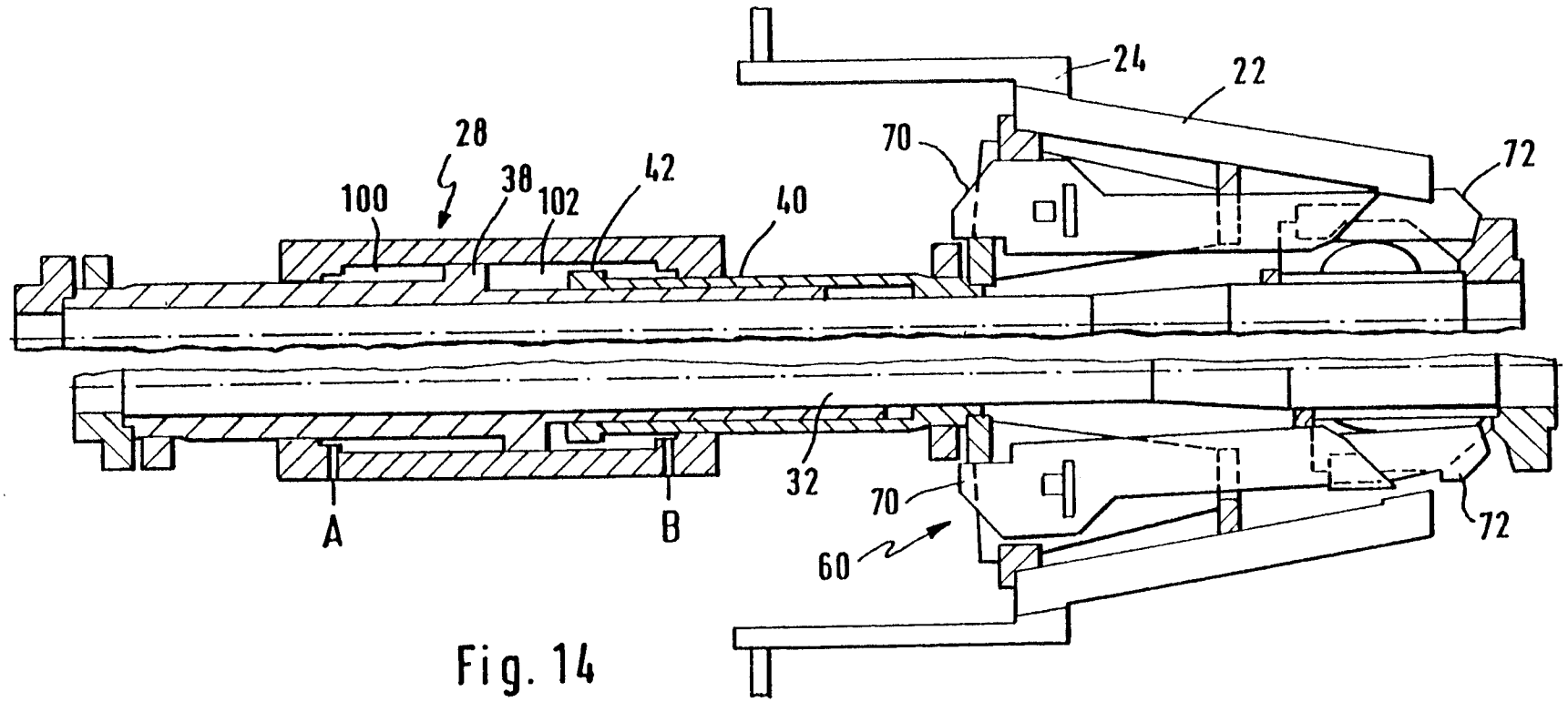
FIG. 14 is a longitudinal section of the first embodiment of the hydraulic ram.
Figure 15:
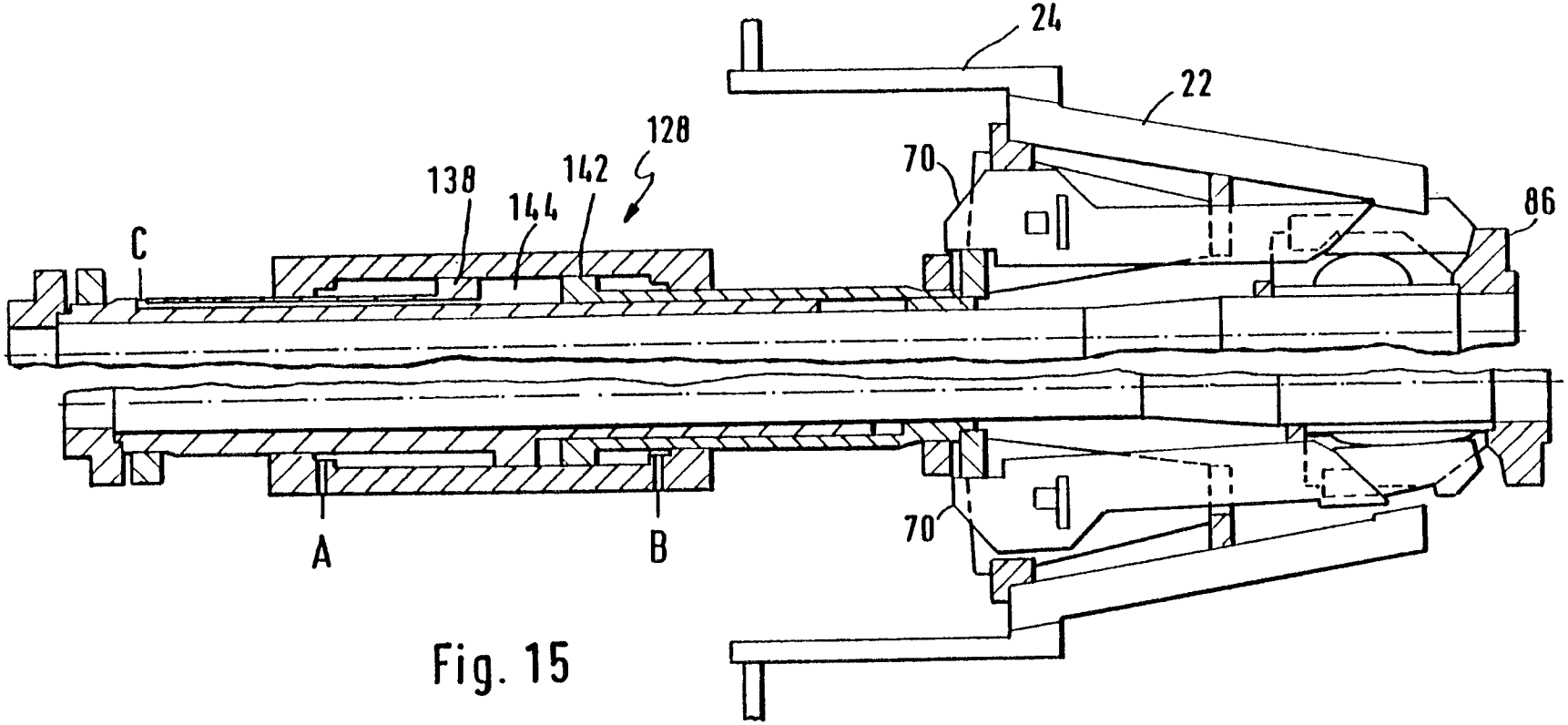
FIG. 15 shows a second embodiment of the hydraulic ram.

FIGS. 14 to 17 illustrate different forms of construction of the hydraulic ram intended for operating the gripper. Each of these figures shows the top part of the ram in the closed position of the gripper, and the bottom part in the open position of the gripper. FIG. 14 shows once again the ram already described with reference to FIGS. 9 to 13, the only difference being the renaming of the pipes 104 and 106 as A and B respectively. In this figure the top part of the ram, above the longitudinal axis, corresponds to the position illustrated in FIG. 10, whereas the bottom part, below the longitudinal axis, corresponds to the position shown in FIG. 9. FIG. 15 illustrates a second form of construction of a ram 128, whose essential difference from the form of construction shown in FIG. 14 is the fact that the two positions 138 and 142 have the same diameter and are both guided leak-tightly in the cylinder of the ram 128. These two piston 138 and 142 can consequently define between them, depending on their positions, a third chamber 144 which is connected to the hydraulic circuit by a third pipe C. The closing of the gripper 30 is effected by pressurizing the chamber 144 by connecting C to P and connecting the outer chambers A and B to the reservoir T. The gripper thus closed can be introduced together with the tymp or the tuyere into the main arch 24 by connecting A to P, or be withdrawn from the main arch 24 by connecting B to P. The opening of the gripper 30 is effected by depressurizing the chamber 144 to T of the reservoir and connecting the communications A and B to the hydraulic pressure P. The open gripper can then be moved on one side or the other, depending on whether it is A or B which is connected to the pressure T of the reservoir. In his embodiment, illustrated in FIG. 125, the pistons 138 and 142 are therefore no longer subjected to differential pressure effects, so that lower hydraulic pressures are sufficient to actuate them. This embodiment also has the advantage of offering more operating possibilities and easier control.

The table below is a summary table of the operation of the rams shown in FIGS. 14 and 15 for all the possible movements, with an indication of the connection of the connections A, B, or C either in the hydraulic pressure P or to the reservoir pressure T.

| | FIG. 14 | FIG. 15 |
|---|---|---|
| 1. Gripper closed | A:P<br>B:P | A:T<br>B:T<br>C:P |
| a. Introduced | A:T<br>B:P | A:T<br>B:P<br>C:P |
| b. Withdrawn | A:P<br>B:½ P | A:P<br>B:T<br>C:P |
| 2. Gripper open | A:P<br>B:T | A:P<br>B:P<br>C:T |
| a. Introduced | A:P<br>B:T | A:P<br>B:T<br>C:T |
| b. Withdrawn | only by displacement of the entire apparatus | A:T<br>B:P<br>C:T |

Figure 16:
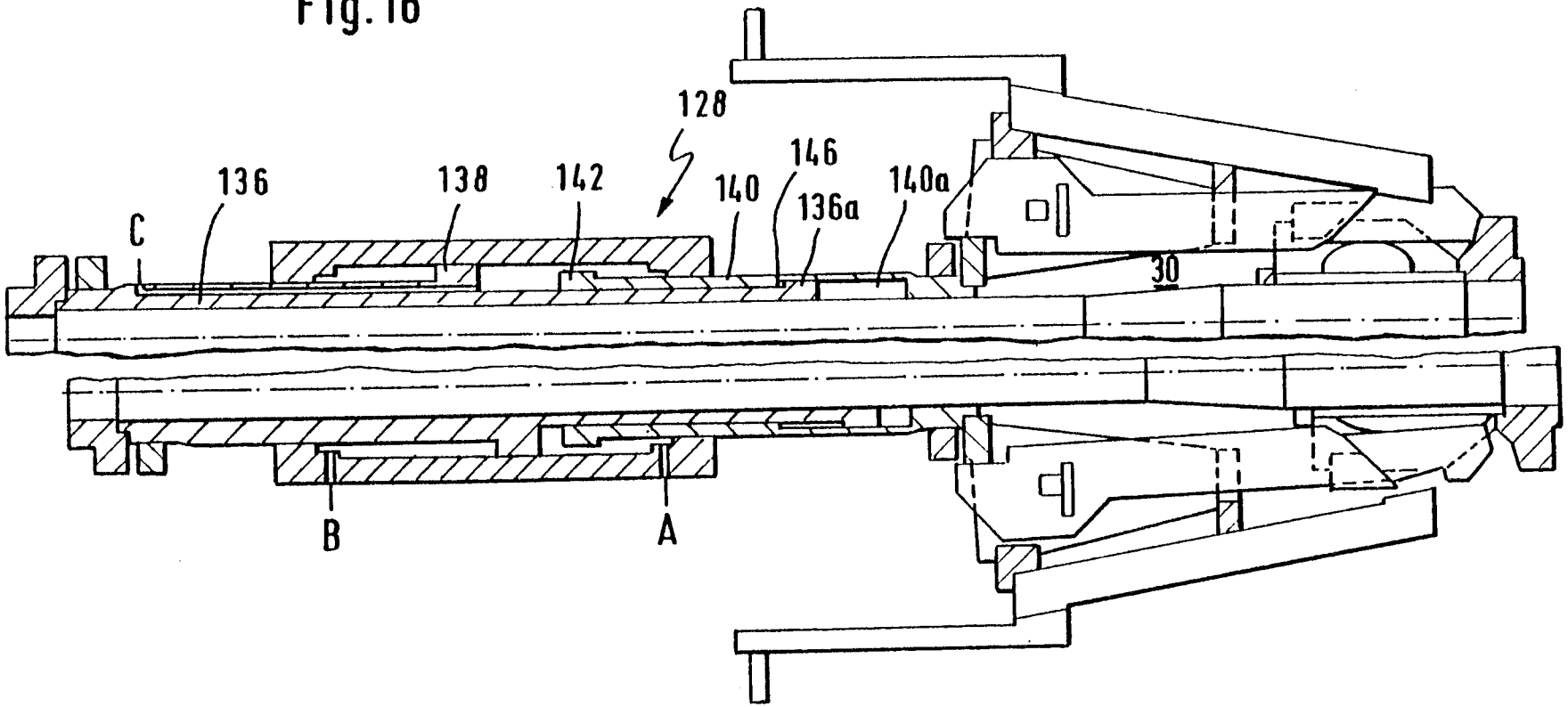
FIG. 16 shows a first modification of the first or second embodiment of the hydraulic ram.
Figure 17:
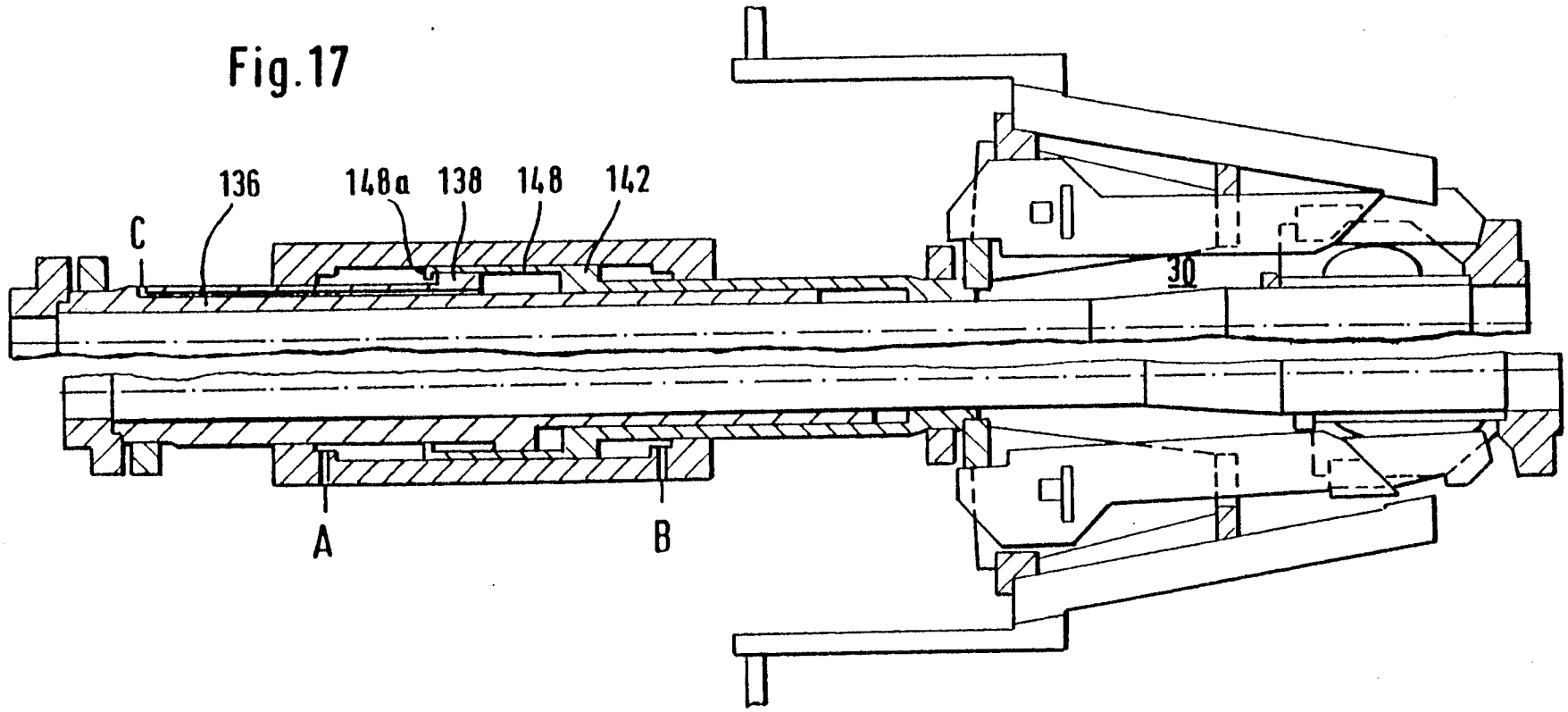
FIG. 17 shows a second modification of the first or second embodiment of the hydraulic ram.

FIGS. 16 and 17 illustrate two variants of the embodiment shown in FIG. 15, each having a means of limiting the amplitude of the closing of the gripper. This means that the gripper cannot be closed beyond a certain limit, the purpose of this being in particular to prevent accidents when the gripper is not loaded with a tuyere or a tymp.

In the variant shown in FIG. 16, the means limiting the closing movement of the gripper 30 is composed of the sheaths 136 and 140, which are shown in FIG. 16, the end of the sheath 136 on the side of the gripper 30 has a projecting edge **136*a* which extends into a corresponding internal widening 140*a* of the sheath 140. The closing movement of the gripper 30 consequently stops when the inside edge of the projection 136*a* is halted by the corresponding edge of the widening 140*a*, which means that the reserve of movement indicated by 146** has disappeared.

In the variant shown in FIG. 17, the movement limiting means consists of the pistons 138 and 142. In this variant, one of the pistons, in this particular case the piston 138, has a diameter smaller than the inside diameter of the hydraulic cylinder, while the other piston, is this particular case the piston 142, is extended in the direction of the piston 138 by a tube 148 which extends through the annular space between the piston 138 and the inside wall of the cylinder of the ram 128 and which, beyond the piston 138, ends in a radial edge forming a circular opening of a diameter smaller than the outside diameter of the piston 138, so that the latter is halted, in its movement closing the gripper 30, by this edge **148*a*. The piston 138 must of course be guided leak-tightly inside the tube 148**.

The movement limiting means shown in FIGS. 16 and 17 have been illustrated in connection with the embodiment shown in FIG. 15. However, they can equally well be provided in the embodiment shown in FIG. 14.

While preferred embodiments have been shown and described, various modifications and substitutions may be made thereto without departing from the spirit and scope of the invention. Accordingly, it is to be understood that the present invention has been described by way of illustrations and not limitations.

What is claimed is:

1. An apparatus for selectively installing or removing a tuyere or a tymp from a wall of a shaft furnace, comprising:

support means for positioning the apparatus against the furnace wall;

gripper means, mounted on said support means, for gripping the tuyere or tymp, said gripper means comprising a propelled member for installing the tuyere or tymp and a pulled member for removing the tuyere or tymp; and hydraulic ram means for axially displacing the gripper means relative to the wall of the furnace, said hydraulic means including a thrust piston for urging the propelled member toward the wall and a traction piston for urging the pulled member away from the wall.

2. The apparatus of claim 1, wherein the ram means includes a rear face facing axially away from the wall, the tuyere defines an internal passage and said internal passage includes a point of smallest cross section and wherein the pulled member comprises a cylinder rod, said rod having a cross section smaller than the smallest cross section of the internal passage, which passes axially through the ram means and is secured within a first coaxial sheath member, said first coaxial sheath member passing sealingly through the rear face of the ram means and forming said traction piston.

3. The apparatus of claim 2, wherein the ram means includes a front face opposite said rear face and the internal passage is defined by an internal surface of the tuyere and the rod extends from a rear end to a front end and the front end includes hook means for gripping the internal surface of the tuyere.

4. The apparatus of claim 2, wherein the propelled member comprises a second coaxial sheath surrounding the first coaxial sheath, said second coaxial sheath passing sealingly through the front face of the ram means to a front end and forming said thrust piston.

5. The apparatus of claim 4, further comprising a cylindrical extension for attaching the front end of the second coaxial sheath so as to bear against the tuyere.

6. The apparatus of claim 1, further comprising means for selectively adjusting inclination of the ram means.

7. The apparatus of claim 1, further comprising:

grabber means for hooking the tymp to the gripper means, said gripper means being secured to said propelled member and actuated by said pulled member.

8. The apparatus of claim 7, wherein the grabber means comprises three pairs of legs extending radially from the pulled member and three claws each mounted between a respective pair of legs, said pairs of legs being circumferentially spaced apart at intervals of 120° around the pulled member and wherein each of the claws is operatively associated with the pulled member so that axial displacement of the pulled member radially displaces said claws.

9. The apparatus of claim 8, wherein each of the claws includes an inclined ramp and further comprising:

a sleeve secured to said pulled member;

cam means, within said sleeve and axially displaceable by axial displacement of the pulled member, for bearing against the inclined ramps to radially inwardly retract the claws; and resilient means for urging each of the claws radially outwardly.

10. The apparatus of claim 9, wherein each of the claws is axially displaceable and further comprising stop means, provided on said pairs of legs, for limiting the axial displacement of each of the claws.

11. The apparatus of claim 2, further comprising:

hammer means secured to the first coaxial sheath for applying percussive forces to said pulled member.

12. The apparatus of claim 4, wherein the traction piston and the thrust piston have a differential action and wherein the thrust piston has a smaller diameter than the traction piston.

13. The apparatus of claim 4, wherein the thrust piston and traction piston are substantially identical and the pistons define three hydraulic chambers with the ram means disposed respectively on either side of and between the pistons.

14. The apparatus of claim 1, wherein the ram means includes limit means for limiting the amplitude of closing of the gripper means.

15. The apparatus of claim 14, wherein the limit means comprise stops provided respectively on the first and second coaxial sheaths.

16. The apparatus of claim 14, wherein the limitations comprises a cylindrical tube secured to one of the pistons and extending beyond the other piston, said tube including stop means for holding back said other piston.

* * * * *

UNITED STATES PATENT AND TRADEMARK OFFICE
CERTIFICATE OF CORRECTION

PATENT NO. : 5,127,633

DATED : July 7, 1992

INVENTORS : Pierre Mailliet

It is certified that error appears in the above-identified patent and that said Letters Patent is hereby corrected as shown below:

On the title page, Item [73] Assignee:
Title: Delete "Paul Wirth, S.A." and insert therefor --Paul Wurth, S.A.--.

Col. 2, line 23: Delete "A - A" and insert therefor --3A - 3A--.

Col. 2, line 24: Delete "B - B" and insert therefor --4 - 4--.

Col. 3, line 7: Delete "extensin" and insert therefor --extension--.

Col. 4, line 15: Delete "Per se" and insert therefor --per se--.

Col. 4, line 44: Delete "three gripper 70" and insert therefor --three claws 70--.

Col. 4, line 67: Delete "paris" and insert therefor --pairs--.

Col. 5, line 3: Delete "cooperated" and insert therefor --cooperate--.

Col. 5, line 10: Delete "operating" and insert therefor --operation--.

Col. 5, line 30: Delete "80 82" and insert therefor --80, 82--.

Col. 6, line 17: Delete "that that" and insert therefor --than that--.

Col. 7, line 11: Delete "traction" and insert therefor --fraction--.

Col. 7, line 29: Delete "piston" and insert therefor --pistons--.

UNITED STATES PATENT AND TRADEMARK OFFICE
CERTIFICATE OF CORRECTION

PATENT NO. : 5,127,633

DATED : July 7, 1992

INVENTORS : Pierre Mailliet

It is certified that error appears in the above-identified patent and that said Letters Patent is hereby corrected as shown below:

Col. 7, line 44: Delete "his" and insert therefor --this--.

Col. 8, line 33: Delete "other piston, is" and insert therefor --other piston, in--.

Signed and Sealed this

Twenty-eighth Day of December, 1993

Bruce Lehman

*Attest:*

BRUCE LEHMAN

*Attesting Officer*

*Commissioner of Patents and Trademarks*